US006219858B1

(12) United States Patent
Farmer

(10) Patent No.: US 6,219,858 B1
(45) Date of Patent: Apr. 24, 2001

(54) CASCADE BATH SPOUT APPARATUS

(75) Inventor: Jacques Farmer, Ile Bizard (CA)

(73) Assignee: 3502767 Canada Inc., Quebec (CA)

( * ) Notice: Subject to any disclaimer, the term of this patent is extended or adjusted under 35 U.S.C. 154(b) by 0 days.

(21) Appl. No.: 09/373,443

(22) Filed: Aug. 12, 1999

(51) Int. Cl.[7] ..... E03C 1/00
(52) U.S. Cl. ..... 4/674; 4/678
(58) Field of Search ..... 4/591, 674, 678, 4/671

(56) References Cited

U.S. PATENT DOCUMENTS

| | | | | |
|---|---|---|---|---|
| 399,691 | * | 3/1889 | Newell | 4/674 |
| 1,427,567 | * | 8/1922 | Yeiser | 4/674 |
| 1,466,895 | * | 9/1923 | Edelman | 4/674 |
| 1,658,159 | | 2/1928 | Ernst et al. | 4/674 X |
| 1,994,789 | | 3/1935 | Redmond et al. | 4/674 X |
| 3,156,931 | | 11/1964 | Holtman | 4/591 X |
| 4,334,328 | | 6/1982 | Delepine | 4/678 |
| 4,722,102 | | 2/1988 | Neugart et al. | 4/671 |
| 5,180,111 | * | 1/1993 | Hart | 4/678 X |

FOREIGN PATENT DOCUMENTS

| | | |
|---|---|---|
| 138255 | 12/1911 | (CA) . |
| 286707 | 1/1929 | (CA) . |
| 2219325 | 10/1973 | (DE) . |
| 2653754 | 6/1978 | (DE) . |
| 8707328 | 7/1987 | (DE) . |
| 8903039 | 7/1989 | (DE) . |
| 0645497 | 3/1995 | (EP) . |
| 0671514 | 9/1995 | (EP) . |
| 0731222 | 9/1996 | (EP) . |
| 0741259 | 11/1996 | (EP) . |

* cited by examiner

*Primary Examiner*—Robert M. Fetsuga
(74) *Attorney, Agent, or Firm*—Volpe and Koenig, P.C.

(57) ABSTRACT

There is provided a new and useful bath spout apparatus for a bath having a water inlet supply pipe and a water outlet overflow opening. The apparatus comprises a body, a water inlet to be connected to the water inlet supply pipe and a spout in fluid connection with the water inlet to allow water to pass from the water inlet supply pipe through the water inlet into the body and out of the spout into the bath. There is further provided a water outlet to allow overflow water to flow from the bath. The apparatus is constructed so as to be mounted in the bath contiguous with the overflow opening.

14 Claims, 5 Drawing Sheets

CASCADE BATH SPOUT APPARATUS

FIELD OF THE INVENTION

This invention relates to a bath spout for use in combination with the overflow opening of a bathtub.

BACKGROUND OF THE INVENTION

For many homeowners, the bathtub has gone beyond simply a place to wash. It is now something that must be stylish and that must fit within the decor of the room, as well as the house as a whole. Thus, tubs today are often larger and have a shape other than the classic rounded rectangle.

One problem with creating a stylish bathtub is the spout, which is also a very expensive item in the bathtub. Rather than adding to the overall appearance of the tub, the spout typically is a large piece of metal which must be high and long enough to reach over the bath ledge. The end result is an obstacle the user must avoid.

In order to create a stylish design, therefore, it would be preferable to have a streamline design for a spout. Such a design must compete, however, with the practical functioning of the tub and the spout as the means to fill the tub. Another such function is the overflow protection provided by the overflow opening standard in bathtubs.

It is therefore desirable to have a device which can blend in to the styling of the tub and which can nonetheless perform the necessary function of filling the tub. A device which similarly cooperated with the standard overflow opening and which could be sold either as part of the tub or as a retrofit for existing tubs would also be preferable. A spout with a high flow rate is also important, particularly for today's larger tubs.

The applicant is aware of attempts in the prior art to combine a spout and a water overflow outlet in which the overflow outlet has been re-engineered to allow for the bath spout function. Reference may be had for example to U.S. Pat. No. 1,658,159 of Ernst et al., issued Feb. 7, 1928, U.S. Pat. No 1,994,789 of Redmond et al., issued Mar. 19, 1935, U.S. Pat. No. 4,722,102 of Neugart et al., issued Feb. 2, 1988, Canadian Patent 286,707 of Brotz, issued Jan. 22, 1929, and Canadian Patent 138,255. U.S. Pat. No. 3,156,931 of Holtman, issued Nov. 17, 1964 and U.S. Pat. No. 4,334, 328 of Delepine, issued Jun. 15, 1982 each describe a means of generating a cascade flow of water into a bath, using a different structure from the applicant's and not cooperating with the existing overflow opening of the bath.

SUMMARY OF THE INVENTION

It is thus an object of the present invention to provide a bath spout for use in combination with the overflow opening of a bathtub, which spout provides a stylish yet nonetheless effective means of filling the bathtub and which can be retrofit to an existing bathtub.

In one aspect of the invention, there is provided a water spout apparatus for a bath having a water inlet supply pipe and a water outlet overflow opening. The apparatus comprises a body, a water inlet to be connected to the water inlet supply pipe and a spout in fluid connection with the water inlet to allow water to pass from the water inlet supply pipe through the water inlet into the body and out of the spout into the bath. There is further provided a water outlet to allow overflow water to flow from the bath. The apparatus is constructed so as to be mounted in the bath contiguous with the overflow opening.

In another aspect of the invention, the spout is constructed so as to provide a cascade flow of water from the apparatus into the bath.

In another aspect of the invention, the water outlet comprises an opening positioned in a center of the body so that, in use, the opening is in fluid connection with the overflow opening.

In still another aspect of the invention, the body comprises a hollow inner portion comprising the water inlet, the spout and the outlet and an annular outer portion connected to the inner portion.

In another aspect of the invention, the body comprises a hollow inner portion comprising the water inlet, the spout and the outlet and a penannular outer portion releasably securable to the inner portion.

BRIEF DESCRIPTION OF THE DRAWINGS

These and other advantages of the invention will become apparent upon reading the following detailed description and upon referring to the drawings in which.

Figure 1:
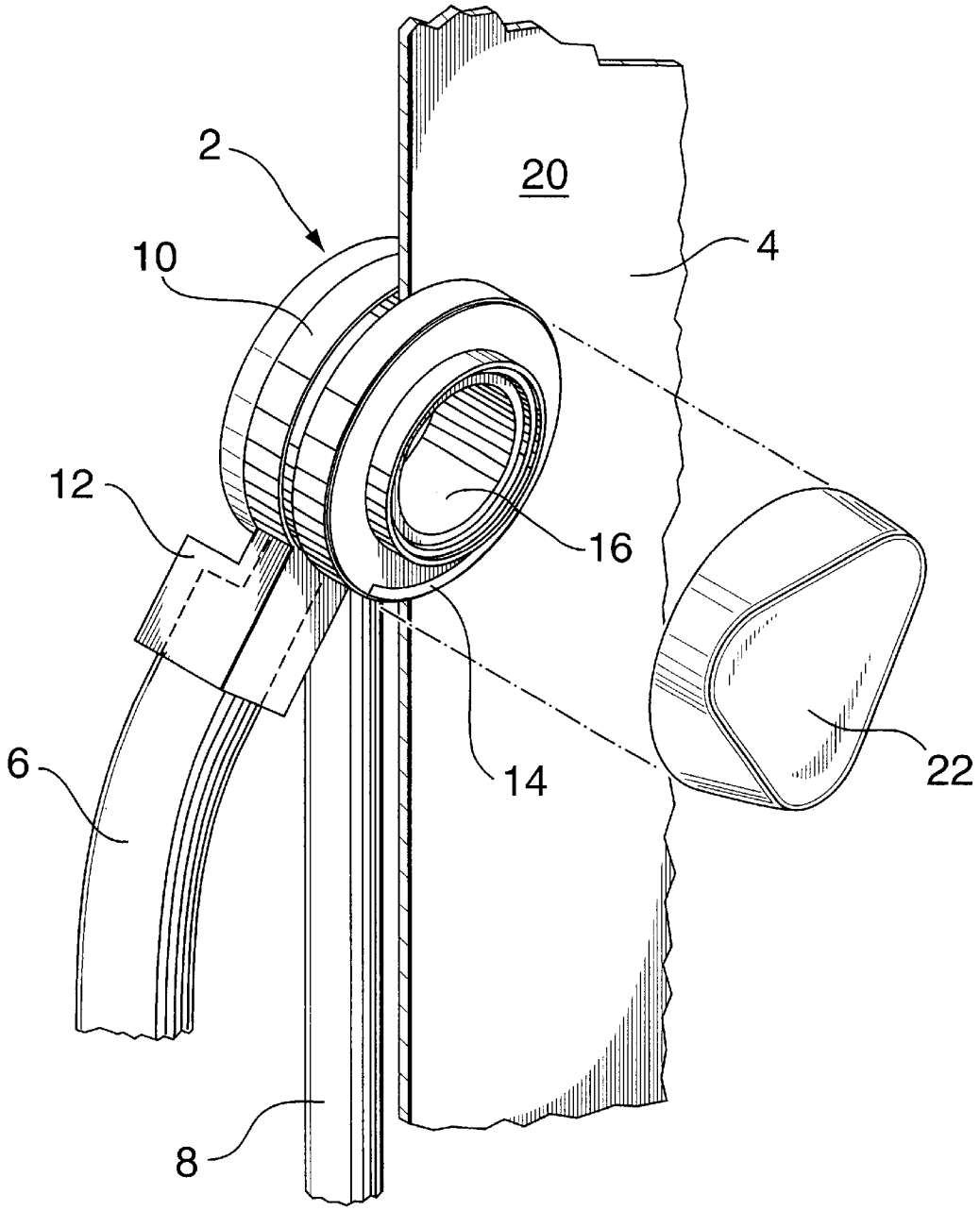
FIG. 1 is a perspective view of the apparatus of the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates a water spout apparatus 2 for use in a bath 4. The bath 4 conventionally comprises a water inlet supply pipe 6 and a water outlet overflow opening and pipe 8, part of a standard drain and overflow package.

The apparatus 2 comprises a body 10 and a water inlet 12 which is to be connected to the water inlet supply pipe 6. The body 10 is preferably of a hollow cylindrical shape. A spout 14 is constructed in fluid connection to the water inlet 12 so as to allow water to pass from the water inlet supply pipe 6 into the body 10 and out of the spout 14, into the bath 4.

There is also provided a water outlet 16 to allow the flow of water from the bath 4 through the overflow opening 8. The apparatus 2 is constructed so that it may be mounted in the bath 4 contiguous with the overflow opening 8, typically flush mounted on a wall 20 of the bath 4 to squarely and solidly seat the apparatus 2 against the bath wall. A decorative cover 22 may be included within the apparatus 2, as part of the overall scope of the present invention.

Figure 2:
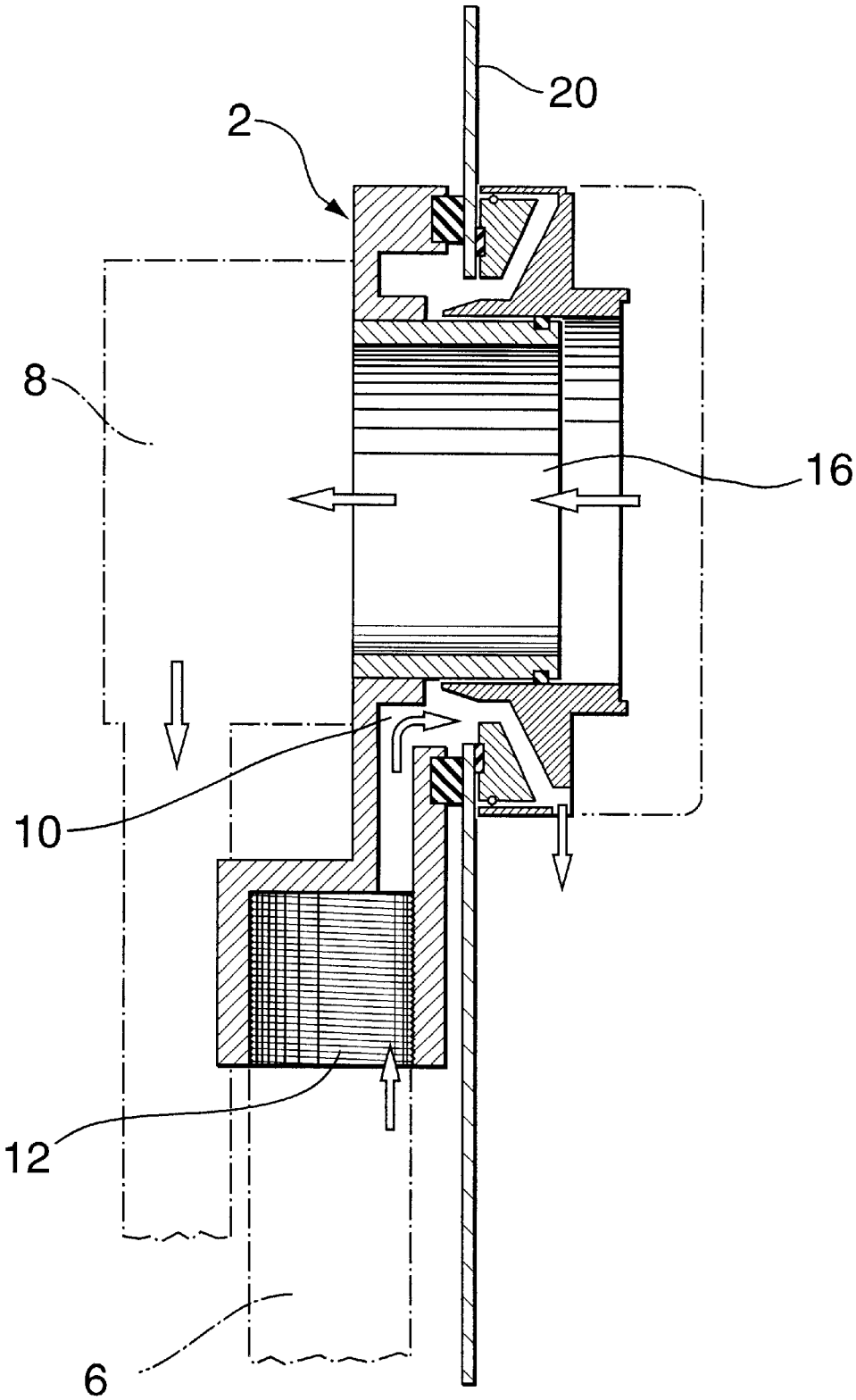
FIG. 2 is a cross-sectional view of the apparatus of FIG. 1.

As shown in FIG. 2, the flow of water through the apparatus 2 is illustrated by the arrows. The water will flow into the apparatus 2 from the water inlet supply pipe 6 and into the water inlet 12 of the apparatus 2. From there, the water can pass through the body 10, to the spout 14 and then flow into the bath 4. As the apparatus 2 is preferably mounted on the wall 20 of the bath 4, contiguous with the overflow opening 8, overflow water can then flow from the bath 4, through the water outlet 16 of the apparatus 2 to the overflow opening 8 of the bath 4 and out, in the conventional fashion.

Figure 3:
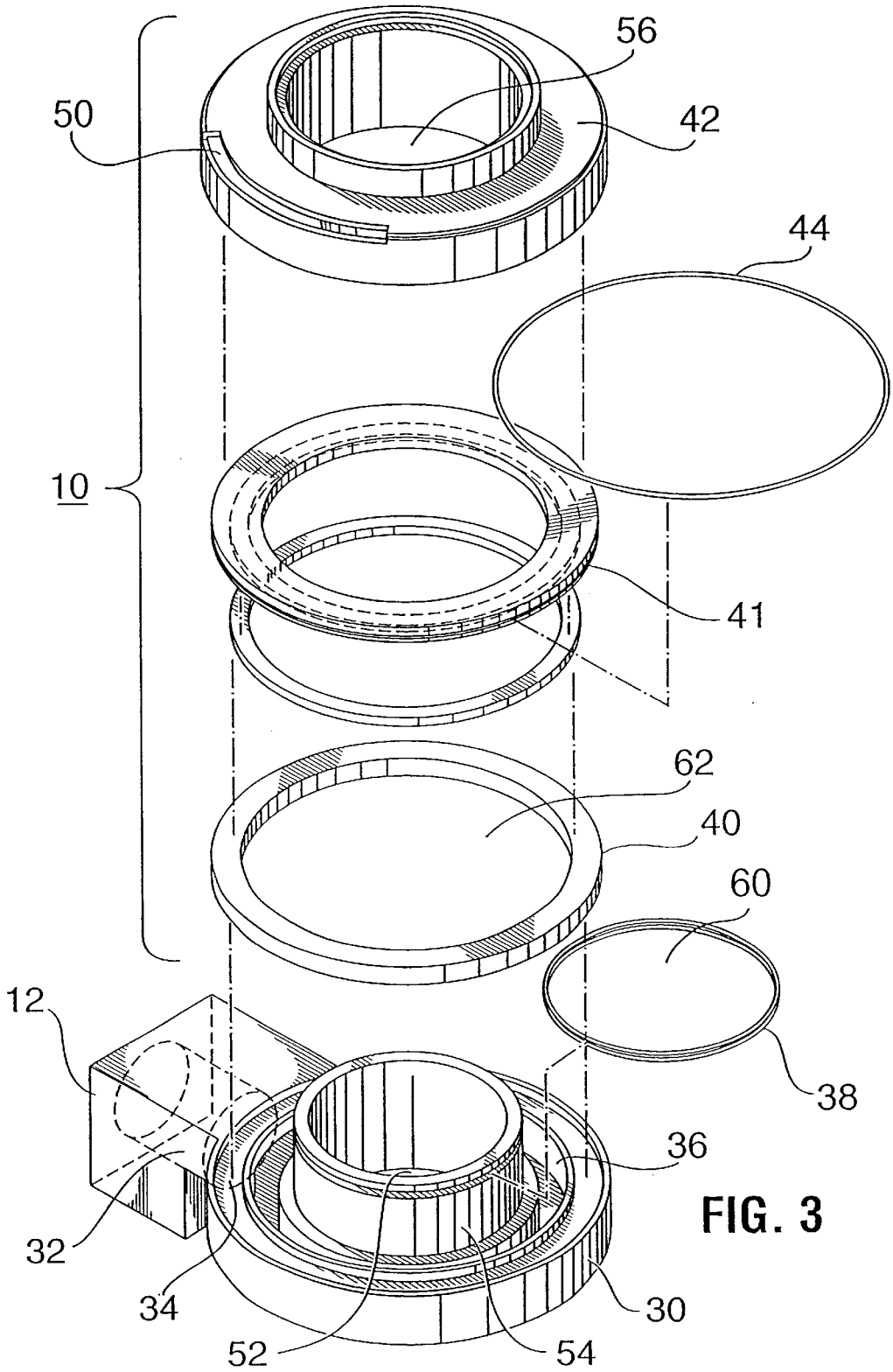
FIG. 3 is an exploded view of the embodiment of the invention shown in FIG. 1.

FIG. 3 illustrates an exploded view of the component parts of the embodiment of the apparatus 2 shown in FIG. 1. The body 10 is primarily comprised of a hollow inner portion 30, which includes the water inlet 12, comprising an aperture 32 in a side 34 of the inner portion 30. The inner portion 30 further comprises a circular groove 36 designed to receive a gasket 38, preferably water impervious.

At least one other gasket ring 40 is provided to also fit within the circular groove 36. An annular outer portion 42 is constructed and sized to connect to the inner portion 30, with the rings 40 and 41 placed in between the two portions 30 and 42. Another gasket 44, again preferably water impervious may be employed between the outer portion 42 and the ring 40, or within the group of rings 40, 41 if more than ring 40 is employed.

In the embodiment of the invention shown in FIGS. 1 to 3, the spout 14 is an elongated aperture 50 in a section of the outer portion 42. The aperture 50 is sized and shaped so as to provide a cascade flow of water from the apparatus 2 into the bath 4.

The water outlet 16 is preferably an opening in the body 10, comprised of an opening 52 in the centre 54 of the inner portion 30 and a concentric opening 56 in the centre of the outer portion 42. The openings 60 and 62 of the gasket 38 and the ring 40 respectively are similarly concentric with the openings 52 and 56. In this manner, the water outlet 16 allows the apparatus 2 to be mounted on the wall 20 contiguous with the existing overflow opening 8 of the bath 4 without interfering with the function of that overflow opening 8.

Figure 4:
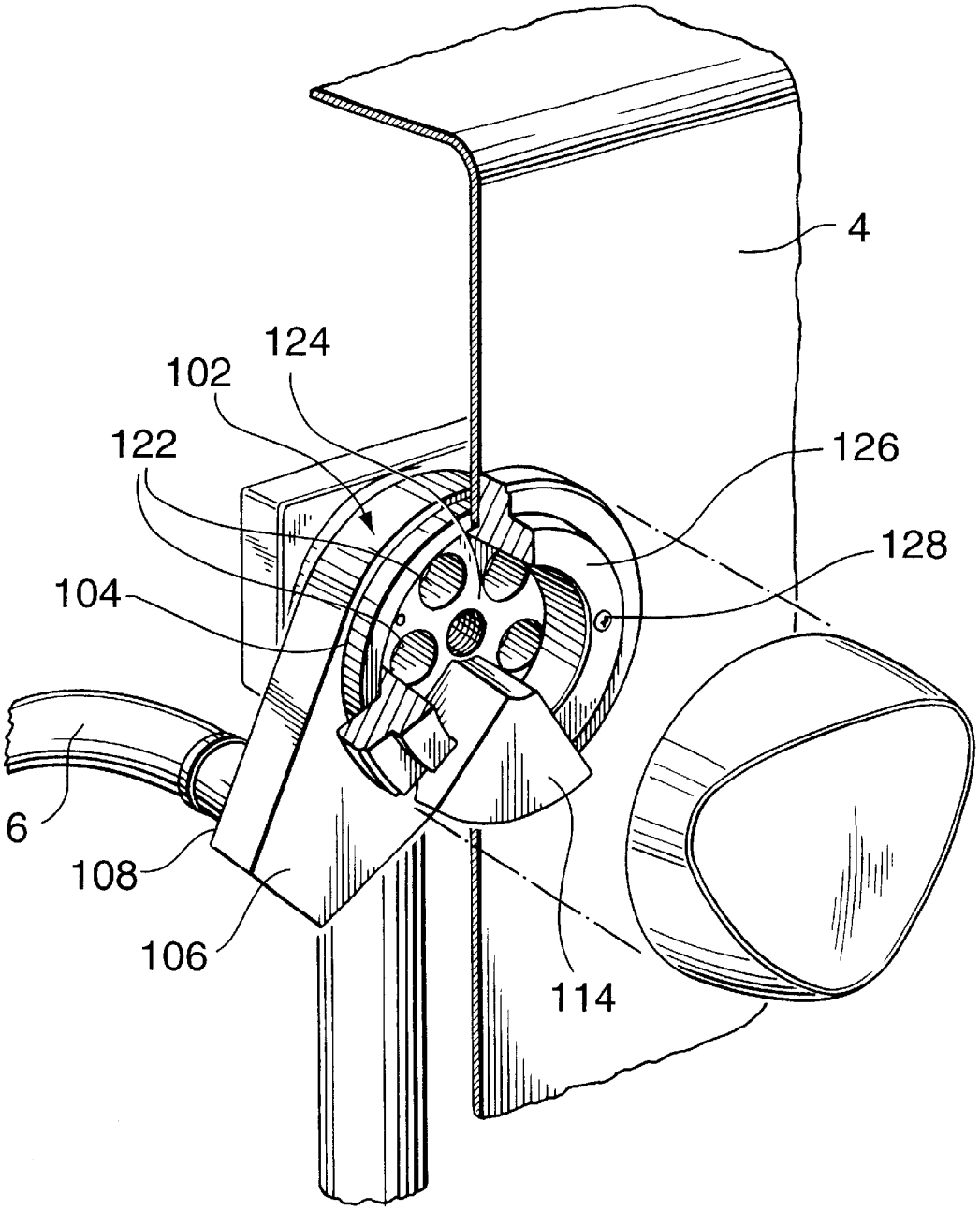
FIG. 4 is a perspective view, partially cutaway, of an alternate embodiment of the apparatus of the present invention.
Figure 5:
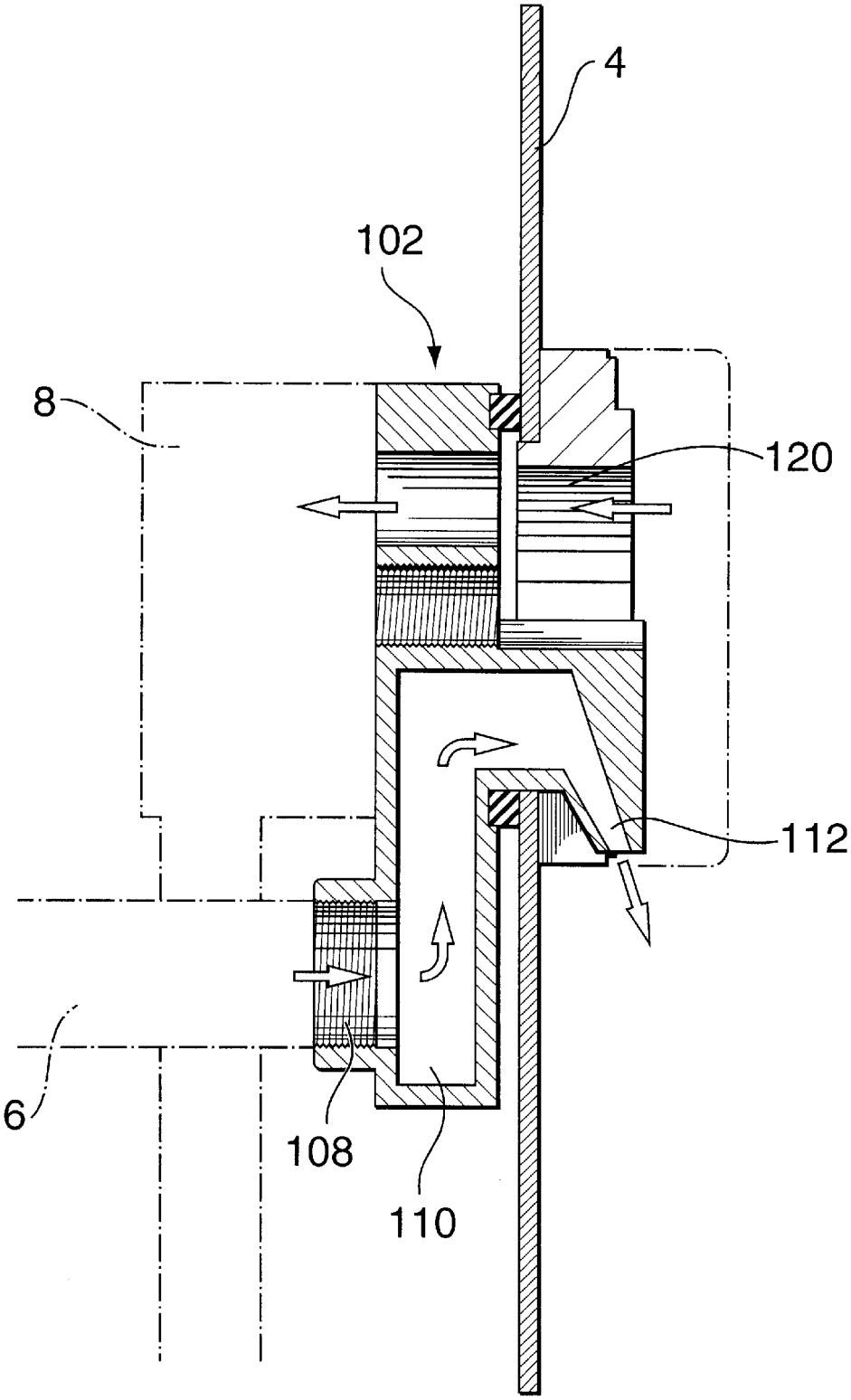
FIG. 5 is a cross-sectional view of the alternate embodiment of the apparatus of FIG. 5.

An alternate embodiment of the invention is shown in FIGS. 4 and 5. The overall principle of construction and operation of the apparatus 102 is the same as apparatus 2 shown in FIGS. 1 to 3.

The body 104 is not cylindrical in shape. Rather, it comprises a tapered projection 106 which houses the water inlet 108 of the apparatus 102, to be connected to the water inlet pipe 6 of the bath 4. From the inlet 108, the water flows through the hollow inner portion 110 to the spout 112, comprising nozzle 114, and out to the bath 4. The nozzle 114 is designed and constructed to provide a similar cascade flow of water as the elongated aperture 50, in the first embodiment, does.

The water outlet 120 comprises a plurality of apertures 122 located within a centre 124 of the inner portion. The outer portion 126 is penannular in construction so that the overflow of water is unimpeded through the apertures 122 to the overflow opening 8 of the bath 4. The opening in the penannular ring is oriented to mate with the nozzle 114 when the outer portion 126 is connected to the inner portion 110, by screws 128 or similar fasteners.

With either embodiment, the apparatus 2 or 102 can be retrofit to an existing bath 4 or can be part of a new construction of a bath, in place of a conventional water spout. A streamline, fashionable appearance is thus achieved.

Thus, it is apparent that there has been provided in accordance with the invention a bath spout that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A water spout apparatus for a bath having a water inlet supply pipe and a water outlet overflow opening, said apparatus comprising:

a body comprising an inner portion and an outer portion fluidly connected to said inner portion;

a water inlet in said inner portion to be connected to said water inlet supply pipe;

a spout in fluid connection with said water inlet to allow water to pass from said water inlet supply pipe through said water inlet into said inner portion and out of said spout into said bath; and a water outlet in said body to allow overflow water to flow from said bath, wherein said apparatus is constructed so as to be mounted in said bath contiguous with said overflow opening.

2. The apparatus of claim 1 wherein said body has a hollow cylindrical shape.

3. The apparatus of claim 1 wherein said body is flush mounted against a wall of said bath, over said overflow opening.

4. The apparatus of claim 1 wherein said spout is constructed so as to provide a cascade flow of water from said apparatus into said bath.

5. The apparatus of claim 4 wherein said spout is a fan-shaped opening in a sidewall of said body.

6. The apparatus of claim 1 wherein said water outlet comprises an opening positioned in a center of said body so that, in use, said opening is in fluid connection with said overflow opening.

7. The apparatus of claim 1 wherein said water inlet is an aperture on a side of said inner portion.

8. The apparatus of claim one wherein said inner portion is hollow.

9. A water spout apparatus for a bath having a water inlet supply pipe and a water outlet overflow opening, said apparatus comprising:

a body comprising a hollow inner portion comprising a water inlet, a spout and a water outlet and a penannular outer portion releasably securable to said inner portion;

said water inlet to be connected to said water inlet supply pipe;

said spout in fluid connection with said water inlet to allow water to pass from said water inlet supply pipe through said water inlet into said body and out of said spout into said bath; and said water outlet to allow overflow water to flow from said bath, wherein said apparatus is constructed so as to be mounted in said bath contiguous with said overflow opening.

10. The apparatus of claim 9 wherein said spout comprises a nozzle on said inner portion.

11. The apparatus of claim 1 constructed so as to be installed on an existing bath.

12. A water spout apparatus for a bath having a water inlet supply pipe and a water outlet overflow opening, said apparatus comprising:

a body comprising a hollow inner portion and a penannular outer portion releasably connected to said inner portion, a water inlet to be connected to said water inlet supply pipe;

a spout in fluid connection with said water inlet to allow water to pass from said water inlet supply pipe through said water inlet into said body and out of said spout into said bath, wherein said spout is a nozzle on said inner portion constructed so as to provide a cascade of water from said body into said bath; and a water outlet comprising an opening positioned in a center of said body so that, in use, said opening is in fluid connection with said overflow opening, wherein said apparatus is constructed so as to be mounted in said bath so that said water outlet cooperates with said overflow opening to allow water to flow from said bath.

13. The apparatus of claim 9 further comprising a water impervious gasket between said inner and outer portions.

14. The apparatus of claim 8 further comprising a water impervious gasket between said inner and outer portions.

* * * * *

UNITED STATES PATENT AND TRADEMARK OFFICE

CERTIFICATE OF CORRECTION

PATENT NO. : 6,219,858 B1
DATED : April 24, 2001
INVENTOR(S) : Jacques Farmer

It is certified that error appears in the above-identified patent and that said Letters Patent is hereby corrected as shown below:

Column 4,
Line 11, -- penannular -- has been inserted before the word "outer".

Signed and Sealed this

Fifteenth Day of January, 2002

*Attest:*

*Attesting Officer*

JAMES E. ROGAN
*Director of the United States Patent and Trademark Office*